United States Patent [19]

Anderson

[11] Patent Number: 4,916,871

[45] Date of Patent: Apr. 17, 1990

[54] UTILITY CONDUIT PROTECTOR

[76] Inventor: Dwayne B. Anderson, 2762 Blume Dr., Los Alamitos, Calif. 90720

[21] Appl. No.: 395,974

[22] Filed: Aug. 21, 1989

[51] Int. Cl.[4] ..... E04C 2/54; E04C 2/52

[52] U.S. Cl. ..... 52/98; 52/105

[58] Field of Search ..... 52/98, 377, 105, 220, 52/221

[56] References Cited

U.S. PATENT DOCUMENTS 4,837,991 6/1989 Shaw ..... 52/98

*Primary Examiner*—Carl D. Friedman
*Assistant Examiner*—Lan Mai
*Attorney, Agent, or Firm*—Grant L. Hubbard

[57] ABSTRACT

A wall construction which comprises a wall panel and a conduit in the wall behind the wall panel, a protector secured in the wall in the area in which the conduit is located, the protector comprisng an L-shaped one-piece sheet metal member defining a base portion and a vertical portion being from about two to about eighteen inches wide and from about two to about eight inches high extending vertically behind the wall panel upwardly covering the portion of a wall in which a conduit is located, the base portion being from about two to about eighteen inches wide and extending perpendicular from the vertical portion adjacent a floor or ceiling of the construction from about two to about eight inches, and an indicia portion formed on the base portion extending outwardly from the wall panel for marking the location of a conduit after installation of a wall with the protector therein is described.

9 Claims, 1 Drawing Sheet

UTILITY CONDUIT PROTECTOR

BACKGROUND OF THE INVENTION

1. Field of the Invention

This invention relates generally to building and construction materials and more specifically to hardware protecting utility conduits such as water pipes, gas pipes, sewer pipes, electrical wires, heating ducts and air conditioning ducts, and to the location in the walls of a constructed building of such conduits.

2. Description of the Prior Art

During the early phases of the construction of a building, the workers at the building site have no problem in locating the utility conduits in the building. Once the sheet rock or other materials used in constructing walls is installed, it is difficult if not impossible to locate the different utility conduits that are located within the walls of the building. As a result of this difficulty, the construction workers will commonly damage a conduit as they are driving nails during the construction process. When a conduit is damaged by a nail penetrating the walls of the conduit, it is necessary to remove a section of the wall so that the damaged conduit can be repaired or replaced.

At some construction sites, the location of the conduits located within the walls are indicated by lines drawn on the floor of the building. After a short time, these lines are hard to find and thus easily missed, resulting in the aforementioned damaged conduits.

It is not uncommon for the repair or replacment of the conduits that have been damaged to cause delays in the construction of the building, thus increasing the cost of construction.

SUMMARY OF THE INVENTION

The Red Flag ™ Utility Conduit Protector of the present invention solves the above-mentioned problems of the construction trade by providing means for protecting and indicating the location within the walls of utility conduits.

The protector is constructed from a sheet metal plate and is generally in an L-shaped form. Before the sheet rock or other wall-forming material is installed, the protector is placed on the floor at what will be the base of the wall where a conduit will be located within the wall. The portion of the conduit protector that extends along the floor, wall or ceiling is of sufficient length as to extend beyond the thickness of the wall-forming material with the attached trim and is color coded so as to attract attention to that area of the wall, thus indicating that a utility conduit is located within the wall at that area, and necessary precautions can be taken so as not to damage the conduit. The portion of the protector that extends upward along the base of the wall is of sufficient length as to extend above the wood or metal material forming part of the base of the wall. The material from which the protector is constructed is a sheet metal of sufficient thickness as to prevent such items as finishing nails from penetrating the protector and thus damaging the conduit, but is not of sufficient thickness as to cause a deformity in the wall or to be noticeable on the floor once the floor covering is installed.

DETAILED DESCRIPTION OF THE PRESENT INVENTION

Figure 1:
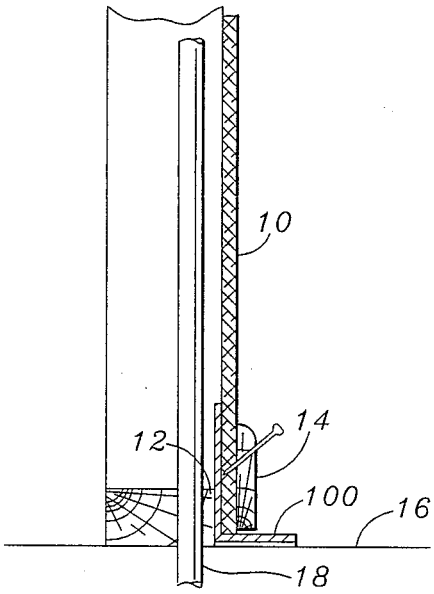
FIG. 1 is a side cross-sectional view showing the Red Flag ™ Utility Conduit Protector in location.
Figure 2:
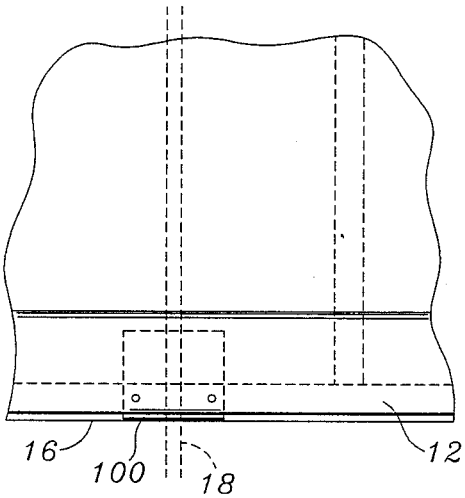
FIG. 2 is a frontal view showing the Red Flag ™ Utility Conduit Protector as it would appear in correct position.

With references to FIGS. 1–2, a section of a wall is shown, the wall panel, e.g. dry wall or plaster wall 10 shown in its normal position relative to the base plate 12 and the floor molding 14, and located between the base plate 12 and the wall panel 10 is the protector 100 extending along the floor 16 providing identification to and protection of conduit 18. Conduit 18 is depicted extending upwardly in the wall, and may be a copper water pipe or a polymer (plastic) water pipe if permitted by code, or any other conduit such as an electrical conduit, air conditioning or heating duct, sewer pipe or gas pipe, though the latter four are less likely to present serious problems because the loss of cool or hot air from the air conditioning or heating duct is not damaging to the walls of the building and because a sewer pipe is thicker and not under pressure, and most codes require a heavy wall gas pipe.

Still referring to FIGS. 1–2, the protector 100 is shown projecting beyond the wall 10 and mop board 14 of sufficient distance for the color portion of the protector to be readily visible once the wall and mop board are in position. Also shown is the vertical portion of the protector 100 extending upward along the inner side of the wall providing protection to conduit 18 from any small nails that may be applied in securing mop board 14 at the base of the wall. Dimensions are not at all critical so long as the conduit is protected, but the vertical portion will usually be from about two inches to about eighteen or more inches wide and from about two inches to about eight or more inches in the vertical dimension. Likewise, as to the base portion which includes the indicia portion 110 to be described, dimensions are not at all critical but the base portion will usually be formed about two inches to about eighteen or more inches wide and from about two inches to about eight or more inches in the horizontal plane, as installed.

Figure 3:
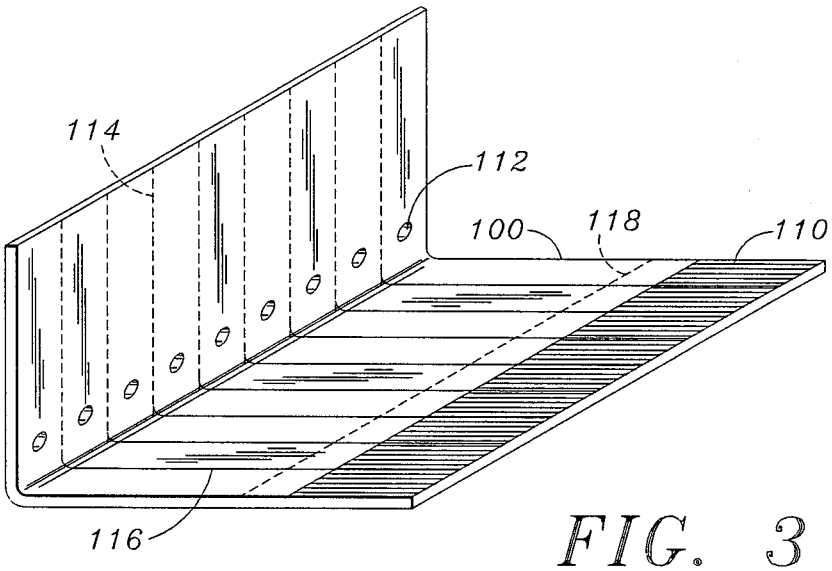
FIG. 3 is a perspective view of the Red Flag ™ Utility Conduit Protector.

Referring to FIG. 3, the protector 100 is in a general L shape with one surface 110 being colored so as to be readily visible after being inserted in place, having performed formed holes 112 by which means the protector 100 is securely fastened in place by means of nails, screws or other like fasteners. A score line 114 is provided on the vertical portion in conjunction with a cut 116 on the base portion extending from the front edge to the vertical portion permitting breaking off a section or sections of the protector and thus allowing the desired width of the protector needed to be achieved.

The protector is installed during the framing or during the installation of the conduits, depending on the order of installation, and before any wall panels are installed. Protectors are most commonly needed adjacent the floor but may also be useful adjacent the ceiling where a molding is to be provided.

Normally, one of the last items to be installed is the floor covering; consequently,the colored indicia portion 110 of the protector is visible during all of the construction steps involved in finishing the building. The construction workers are, consequently, aware that a conduit is present in the wall at a given location and avoid nailing in that area. If, in spite of the warning, a carpenter attempts to nail the floor molding or base board to the base plate or a stud at the location of the conduit, the nail will be deflected by the protector and will not damage the conduit. the floor covering, e.g., carpet, tile, etc. is installed over the indicia portion 110 of the protector.

A score line 118 is also provided, however, in the event it is desired to break off the indicia portion after constuction at the time the floor covering is installed. The workman simply grasps the indicia portion with pliers and bends it up and down two or three times to break off the indicia portion which would otherwise extend under the floor covering.

Thus, as a solution to the problem of a conduit being damaged by a nail or other like device due to the inability to see the conduit enclosed within the completed wall, the invention comprises, as a combination, an improved wall construction which comprises a wall panel and a conduit in the wall behind the wall panel, the improvement comprising a protector secured in the wall in the area in which the conduit is located, the protector comprising an L-shaped one-piece sheet metal member defining a base portion and a vertical portion, the vertical portion being from about two to about eighteen inches wide, having formed therein a score line about every two inches to permit breaking off a section or sections of the protector to achieve the desired width, and from about two to about eight inches high extending vertically behind the wall panel upwardly covering the portion of the wall in which a conduit is located, the base portion being from about two to about eighteen inches wide, being cut about every two inches from the front edge to the vertical portion to permit breaking off a section or sections of the protector to achieve the desired width and extending perpendicular from the vertical portion adjacent a floor or ceiling of the construction from about two to about eight inches, and an indicia portion formed on the base portion extending outwardly from the wall for marking the location of a conduit after installation of a wall with the protector therein. The base portion may have formed therein a score line to permit breaking of all or part of the indicia portion off from the protector after construction is essentially complete.

INDUSTRIAL APPLICATION

This invention is useful in building construction industries.

What is claimed is:

1. A conduit protector comprising an L-shaped one-piece sheet metal member defining a base portion having a front edge and a vertical portion, the vertical portion being from about two to about eighteen inches wide and from about two to about eight inches high, when installed and in use, for extending upwardly in a wall covering a portion of a wall in which conduit is located, the base portion being from about two to about eighteen inches wide and extending perpendicular from the vertical portion from about two to about eight inches, and in indicia portion formed on the base portion for marking the location of a conduit after installation of a wall with the protector therein.

2. The conduit protector of claim 1 wherein the vertical portion has formed therein a score line about every two inches and the base portion has a cut from the front edge to the vertical portion coinciding with the score lines on the vertical portion to permit breaking off a section or sections of the protector thus allowing the desired width of the protector needed to be achieved.

3. The conduit protector of claim 1 wherein the base portion has formed therein a score line to permit breaking of all or part of the indicia portion off from the protector after construction is essentially complete.

4. In a wall construction which comprises a wall panel and conduit in the wall behind the wall panel, the improvement comprising a protector secured in the wall in the area in which the conduit is located, the protector comprising an L-shaped one-piece sheet metal member defining a base portion and a vertical portion, the vertical portion being from about two to about eighteen inches wide and from about two to about eight inches high extending vertically behind the wall panel upwardly covering the portion of a wall in which a conduit is located, the base portion being from about two to about eighteen inches wide and extending perpendicular from the vertical portion from about two to about eight inches, and an indicia portion formed on the base portion extending outwardly from the wall panel for marking the location of a conduit after installation of a wall with the protector therein.

5. The wall construction of claim 4 wherein the vertical portion has formed therein a score line about every two inches and the base portion has a cut from the front edge to the vertical portion coinciding with the score lines on the vertical portion to permit breaking off a section or sections of the protector thus allowing the desired width of the protector needed to be achieved.

6. The wall construction of claim 4 wherein the base portion has formed therein a score line to permit breaking of all or part of the indicia portion off from the protector after construction is essentially complete.

7. In a wall construction which comprises a wall panel and a conduit in the wall behind the wall panel, the improvement comprising a protector secured in the wall in the area in which the conduit is located, the protector comprising an Lshaped one-piece sheet metal member defining a base portion and a vertical portion, the vertical portion being from about two to about eighteen inches wide and from about two to about eight inches high extending vertically behind the wall panel upwardly covering the portion of a wall in which a conduit is located, the base portion being from about two to about eighteen inches wide and extending perpendicular from the vertical portion adjacent a floor or ceiling of the construction from about two to about eight inches, and an indicia portion formed on the base portion extending outwardly from the wall panel for marking the location of a conduit after installation of a wall with the protector therein.

8. The wall construction of claim 7 wherein the vertical portion has formed therein a score line about every two inches and the base portion has a cut from the front edge to the vertical portion coinciding with the score lines on the upright portion to permit breaking off a section or sections of the protector thus allowing the desired width of the protector needed to be achieved.

9. The wall construction of claim 7 wherein the base portion has formed therein a score line to permit breaking of all or part of the indicia portion off from the protector after construction is essentially complete.

* * * * *